US005989053A

United States Patent [19]

Wheeler

[11] Patent Number: 5,989,053

[45] **Date of Patent: *Nov. 23, 1999**

[54] CONTACT ELEMENT FOR AN ELECTRICAL CONNECTOR

[75] Inventor: Roger L. Wheeler, Camp Hill, Pa.

[73] Assignee: Berg Technology, Inc., Reno, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 08/782,714

[22] Filed: Jan. 13, 1997

Related U.S. Application Data

[63] Continuation of application No. 08/631,545, Apr. 12, 1996, abandoned, which is a continuation of application No. 08/487,873, Jun. 7, 1995, abandoned, which is a continuation of application No. 08/180,228, Jan. 12, 1994, abandoned.

[51] Int. Cl.[6] ..... H01R 13/04

[52] U.S. Cl. ..... 439/387; 439/884

[58] Field of Search ..... 439/387, 825–827, 439/884

[56] References Cited

U.S. PATENT DOCUMENTS

| | | | |
|---|---|---|---|
| 2,456,764 | 12/1948 | Bach et al. | 439/827 |
| 2,732,531 | 1/1956 | Janowiec | 439/359 |
| 3,229,242 | 1/1966 | Finney et al. | 439/679 |
| 3,278,885 | 10/1966 | Klinger | 439/279 |
| 3,422,395 | 1/1969 | Fisher | 439/889 |
| 3,546,665 | 12/1970 | Zak | 439/825 |
| 3,858,956 | 1/1975 | Garrett | 439/387 |
| 4,734,041 | 3/1988 | Bruchmann et al. | 439/637 |
| 5,174,777 | 12/1992 | Carter | 439/290 |
| 5,273,455 | 12/1993 | MacLellan | 439/387 |

FOREIGN PATENT DOCUMENTS

| | | |
|---|---|---|
| 11 61 332 | 1/1964 | Germany . |
| 4024478 A1 | 2/1991 | Germany . |
| 0 122 758 | 10/1984 | United Kingdom . |
| 0 283 118 | 9/1988 | United Kingdom . |

OTHER PUBLICATIONS

IBM Technical Disclosure, vol. 27, No. 12, p. 7136, May 1985.

*Primary Examiner*—Neil Abrams
*Attorney, Agent, or Firm*—Woodcock Washburn Kurtz Mackiewicz & Norris LLP

[57] ABSTRACT

An electrical connector includes a number of contact elements that, in the preferred embodiment, are pins. Each pin includes an electrically conductive contact surface that is configured to engage an electrically conductive surface within a mating connector to achieve an electrical connection. Each pin also includes a leading surface that is integral with the contact surface and is configured to contact the conductive surface of the mating connector during connection and disconnection with the mating connector. One advantageous feature of the invention is the provision of a detent between the leading surface and the contact surface. The detent collects surface debris from the leading surface before the debris can be swept onto said contact surface during connection. As a result, any debris that is collected in the detent will not interfere with the electrical connection between the pin and the conductive surface in the mating connector.

21 Claims, 5 Drawing Sheets

CONTACT ELEMENT FOR AN ELECTRICAL CONNECTOR

This is a continuation, of application Ser. No. 08/631.545, filed Apr. 12, 1996 which is a continuation of application Ser. No. 08/487,873, filed Jun. 7, 1995, which is a continuation of application Ser. No. 08/180,228, filed Jan. 24, 1994, all cases now abandoned.

BACKGROUND OF THE INVENTION

1. Field of the Invention

This invention relates to an improved contact element for an electrical connector. More specifically, this invention relates to an improved contact element that has a detent defined therein for collecting surface debris during mating and unmating of the contact element with a mating connector.

2. Description of the Prior Art

Contact elements for electrical connectors come in a wide degree of configurations, sizes and materials. Many contact elements, such as the pins that are used in modern high density electrical connectors, are constructed and arranged for sliding engagement with an electrically conductive surface on a mating connector. For example, a mating connector may be a socket that has flexible arms for receiving such a pin element.

It is well known that the presence of contaminants on a contact surface of an electrical connector will adversely affect the quality of the electrical connection that can be achieved. Contamination may result from corrosion of the surface of the contact element, from dust, from marine or perspiration-induced salt contamination, or from a myriad of other factors.

To prevent corrosion of the contact surface, high quality electrical connectors often include contact elements made of a copper base material that is coated or plated with gold. If the gold coating or plating is without imperfections, the contact surface should theoretically be free from the effects of corrosion. Unfortunately, the presence of micropores in the gold coating or plating can permit corrosion of the underlying copper to take place. As a result, corrosion products such as copper chloride can end up on the contact surface and affect the quality of the connection.

By increasing the thickness of the gold coating, the number of micropores can be reduced, or, at some thickness, completely eliminated. However, it will be appreciated that increasing the thickness of the gold coating can significantly add to the cost of the connector.

It is clear that there has existed a long and unfilled need in the prior art for an electrical connector that includes contact elements that are constructed to maintain a high quality electrical connection with a mating connector in a corrosive environment, without requiring a relatively thick, expensive coating of gold thereon.

SUMMARY OF THE INVENTION

Accordingly, it is an object of the invention to provide an improved electrical connector that includes contact elements which are constructed to maintain a high quality electrical connection in a corrosive environment, without a relatively thick, expensive coating of gold thereon.

In order to achieve the above and other objects of the invention, a contact element for an electrical connection that is constructed according to a first aspect of the invention is constructed and arranged for sliding engagement with an electrically conductive surface on a mating connector, and includes an electrically conductive contact surface, the contact surface being constructed and arranged to engage with the electrically conductive surface of the mating connector in order to achieve an electrical connection; a leading surface, integral with the contact surface, that is constructed and arranged to contact the electrically conductive surface of the mating connector during connection and disconnection of the contact element with and from the mating connector; and a detent defined between the leading surface and the contact surface for collecting surface debris from the leading surface before such debris can be wiped onto the contact surface during connection of the contact element to the mating connector, whereby a clean electrical connection may be achieved.

According to a second aspect of the invention, an electrical connector that is constructed and arranged to be connected to a mating electrical connector includes a plurality of contact elements, each of the contact elements being of the type that are constructed and arranged for sliding engagement with an electrically conductive surface on the mating connector, each of the contact elements including an electrically conductive contact surface, the contact surface being constructed and arranged to engage with the electrically conductive surface of the mating connector in order to achieve an electrical connection; a leading surface, integral with the contact surface, that is constructed and arranged to contact the electrically conductive surface of the mating connector during connection and disconnection of the contact element with and from the mating connector; and a detent defined between the leading surface and the contact surface for collecting surface debris from the leading surface before such debris can be wiped onto the contact surface during connection of the contact element to the mating connector, whereby a clean electrical connection may be achieved.

According to a third aspect of the invention, a method of making a secure electrical connection between a contact element and a mating connector that has an electrically conductive surface includes steps of (a) moving the contact element into the mating connector so that a leading surface of the contact element slides against the conductive surface of the mating connector; (b) further moving the contact element into the mating connector that so a detent in the contact element slides past the conductive surface and collects debris from the contact element and the mating connector; and (c) yet further moving the contact element into the mating connector so that a conductive contact surface of the contact element establishes an electrical connection with the conductive surface of the mating connector, whereby the debris that is collected in the detent will not diminish the quality of the electrical connection between the contact element and the electrical connector.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
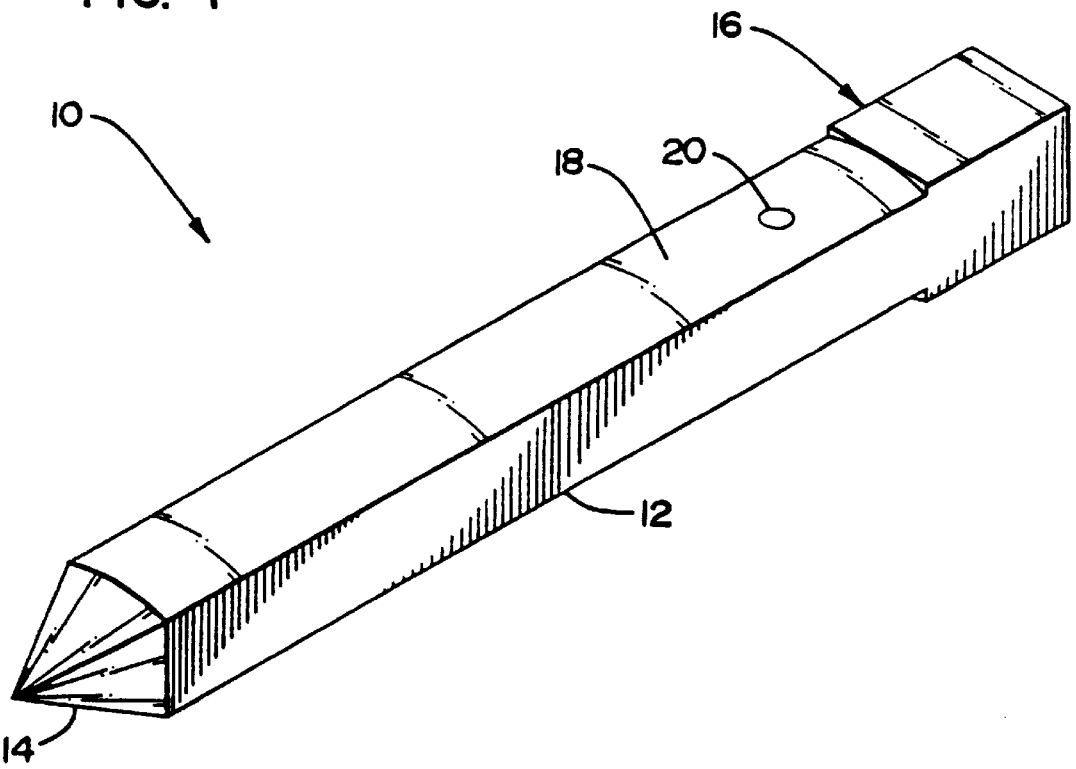
FIG. 1 is a perspective view of a representative prior art contact element for an electrical connector.

Referring now to the drawings, wherein like reference numerals designate corresponding structure throughout the views, and referring first to FIG. 1, a contact element 10 that is typical of contact elements that are presently in use for electrical connectors is embodied as a male pin 12 that has a tapered distal end 14 for insertion into a mating connector and a mounting end 16 that is configured for insertion or installation into an electrical connector. Conventional pin 12 includes at least one contact surface 18 that has a point 20 thereon which is designed for contact with a conductive surface on a mating connector. Contact point 20 may be embodied as a single point, es an area on contact surface 18, or, alternatively, as a linear contact interface. The illustrated conventional pin 12 has a rectangular cross-sectional configuration, but it should be understood that pins having a circular or oval cross-sectional configuration are also presently in use.

Figure 2:
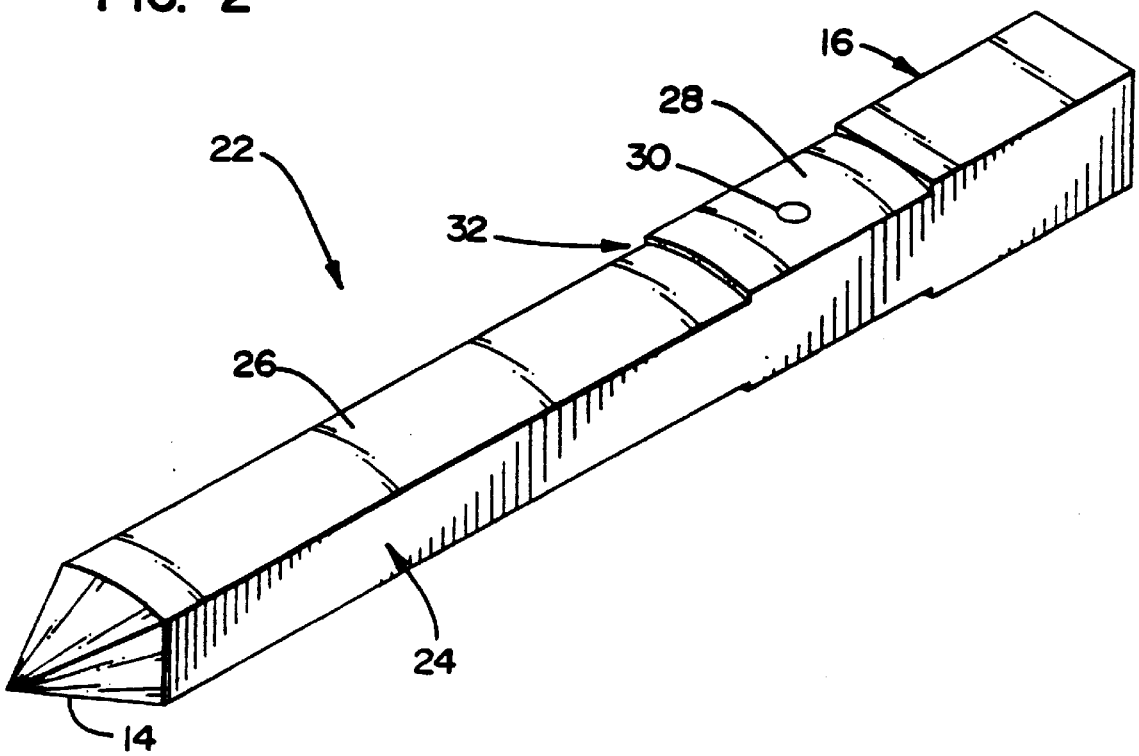
FIG. 2 is a perspective view of a contact element for an electrical connector that is constructed according to a first embodiment of the invention.
Figure 4:
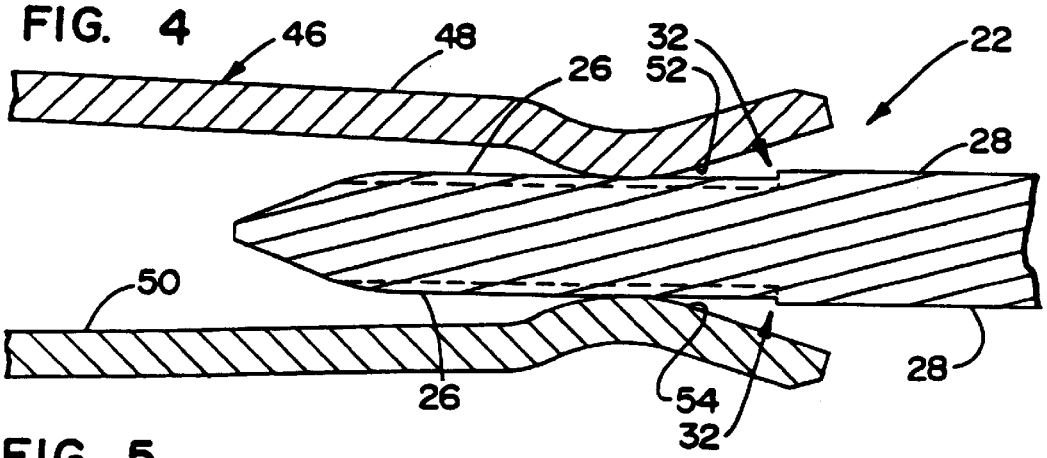
FIG. 4 is a diagrammatical cross-sectional view depicting connection of the contact element shown in FIG. 1 to a mating connector.

An improved contact element 22 that is constructed according to a first embodiment of the invention is depicted in FIG. 2. Contact element 22 is embodied as a unitary pin 24 that has a mounting end 16 and a tapered end 14, in the manner of the above-described conventional contact element. As may be seen in FIG. 2, pin 24 includes a plated leading surface 26 that is constructed and arranged to contact an electrically conductive surface of a mating connector during connection and disconnection of the contact element 22 with and from the mating connector. Leading surface 26 is positioned adjacent to the tapered end 14 on the shaft of unitary pin 24. Pin 24 further includes a plated contact surface 28 that is constructed and arranged to engage an electrically conductive surface of a mating connector at a contact point 30 to achieve an electrical connection. As is discussed above, the plating on surfaces 26, 28 is preferably gold or another conductive noncorrosive material, and is susceptible to micropore corrosion. Leading surface 26 is integral with contact surface 28 and, in the preferred embodiment, is unitary with contact surface 28 as part of the unitary pin 24. A detent 32 is defined between the leading surface 26 and the contact surface 28 for collecting surface debris from the leading surface 26 before such debris can be wiped onto the contact surface 28 during connection of the contact element 22 to the mating connector. Turning briefly to FIG. 4, it will be seen that contact surface 28 is raised with respect to leading surface 26, and that detent 32 is defined by the leading surface 26 and a rise surface that connects leading surface 26 to the raised contact surface 28.

Figure 3:
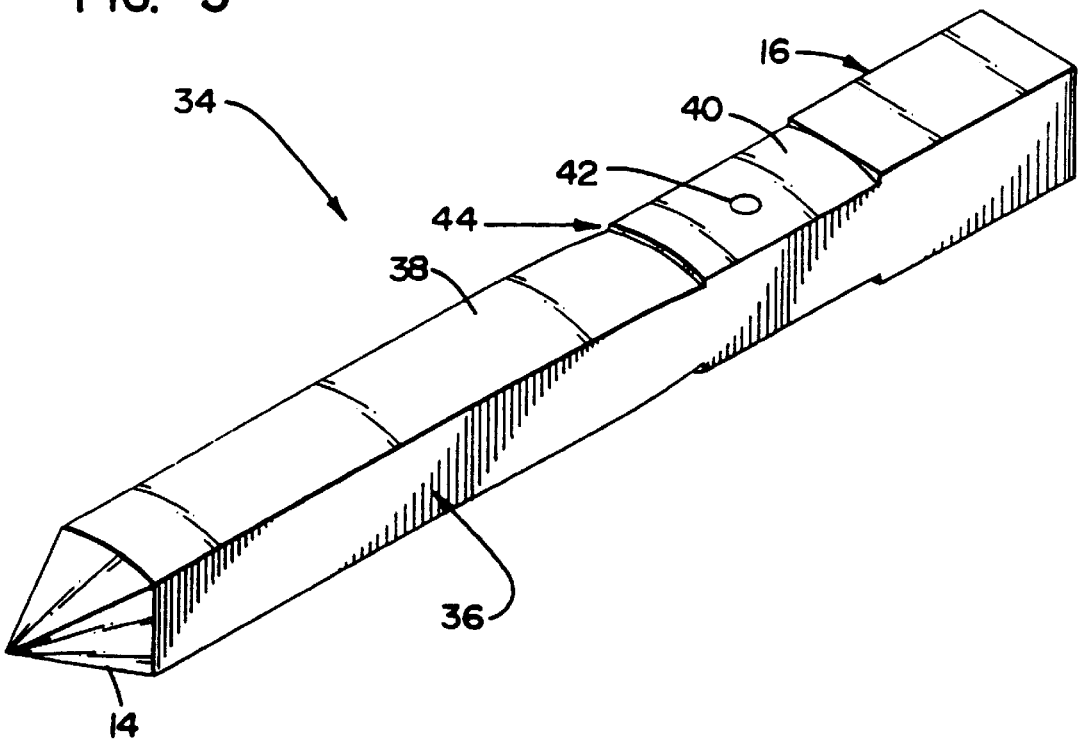
FIG. 3 is a perspective view of a contact element for an electrical connector that is constructed according to a second embodiment of the invention.

An improved contact element 34 that is constructed according to a second preferred embodiment of the invention is depicted in FIG. 3. Contact element 34 is embodied as a unitary pin 36 that has a tapered end 14, a mounting end 16, a leading surface 38, a contact surface 40 having a contact point 42 defined thereon, and a detent 44 that is defined between leading surface 38 and contact surface 40. Contact element 34 differs from the contact element 22 in the first embodiment in that, as may best be seen in FIG. 5, contact surface 40 is substantially colinear with leading surface 38, and in that detent 44 is styled as a groove that is defined between the contact surface 40 and the leading surface 38. As may be seen in FIG. 5, this groove is at Least partially defined by a first surface that intersects the contact surface 40 to form a well-defined edge, so that: debris may be intercepted by the well-defined edge and collected in the groove during connection with a mating connector. The groove is further defined by a second surface that intersects the leading surface 76 to form a tapered, more gentle edge.

Figure 5:
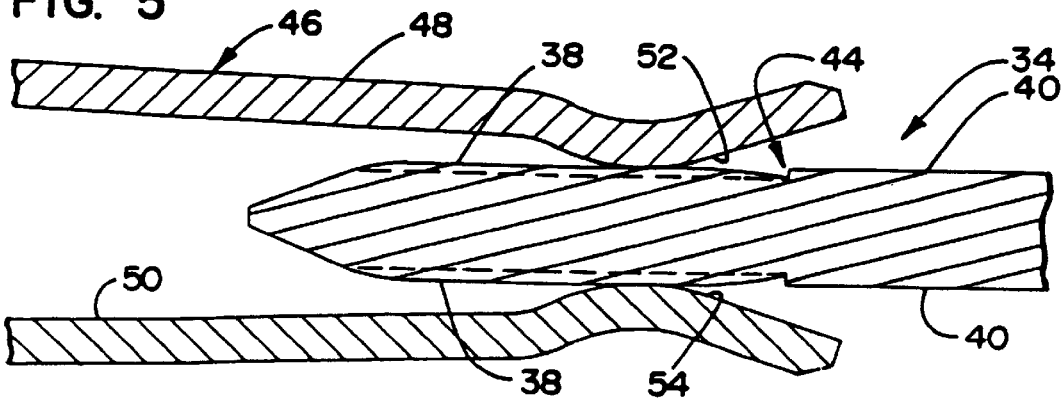
FIG. 5 is a diagrammatical cross-sectional view depicting connection of the contact element shown in FIG. 2 to a mating connector.
Figure 6:
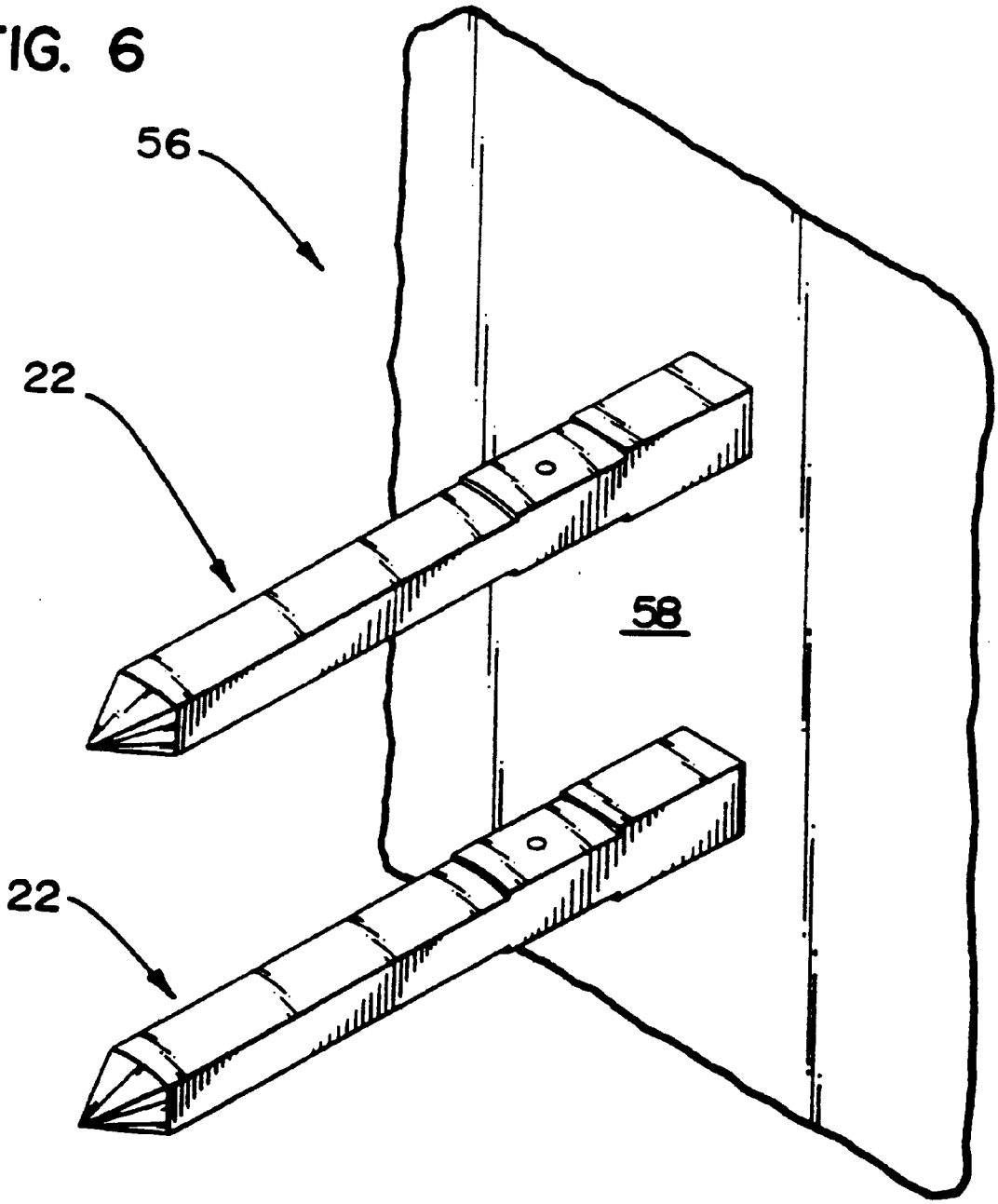
FIG. 6 is a fragmentary perspective view of an electrical connector that incorporates the contact element that is shown in FIG. 2.

It will be noted that the contact elements 22, 34 in the first and second embodiments include pins 24, 36 respectively, that are rectangular in cross section. FIGS. 4 and 5, respectively, depict connection of the contact elements 22, 34 with a mating connector 46. As shown in FIGS. 4 and 5, mating connector 46 includes first and second conductive flexible elements 48, 50 that are opposed to each other and include curved opposing electrically conductive surfaces 52, 54, respectively. Referring to FIGS. 4 and 5, an electrical connector 56 that includes a plurality of contact elements 22 according to the first embodiment will be mated and unmated with a mating connector 46 that has a corresponding plurality of pairs of conductive flexible elements 48, 50. To effect an electrical connection between contact element 22 and mating connector 46, contact element 22 will first be moved into mating connector 46 so that each of the leading surfaces 26 of contact element 22 slide against the respective conductive surface 52, 54 of the mating connector 46. The contact element 22 is then further moved into mating connector 46 so that the detent 32 slides past the respective conductive surface 52, 54 and collects debris that has been separated from the conductive surface 52, 54 and leading surface 26. Contact element is then yet further moved into the mating connector 46 so that the conductive contact surface 28 establishes an electrical connection with the respective conductive surface 52, 54 of the mating connector. As a result of the detent 32, the debris that is collected in the detent 32 will not diminish the quality of the electrical connection that is established between the contact element 22 in the electrical connector 46.

Figure 7:
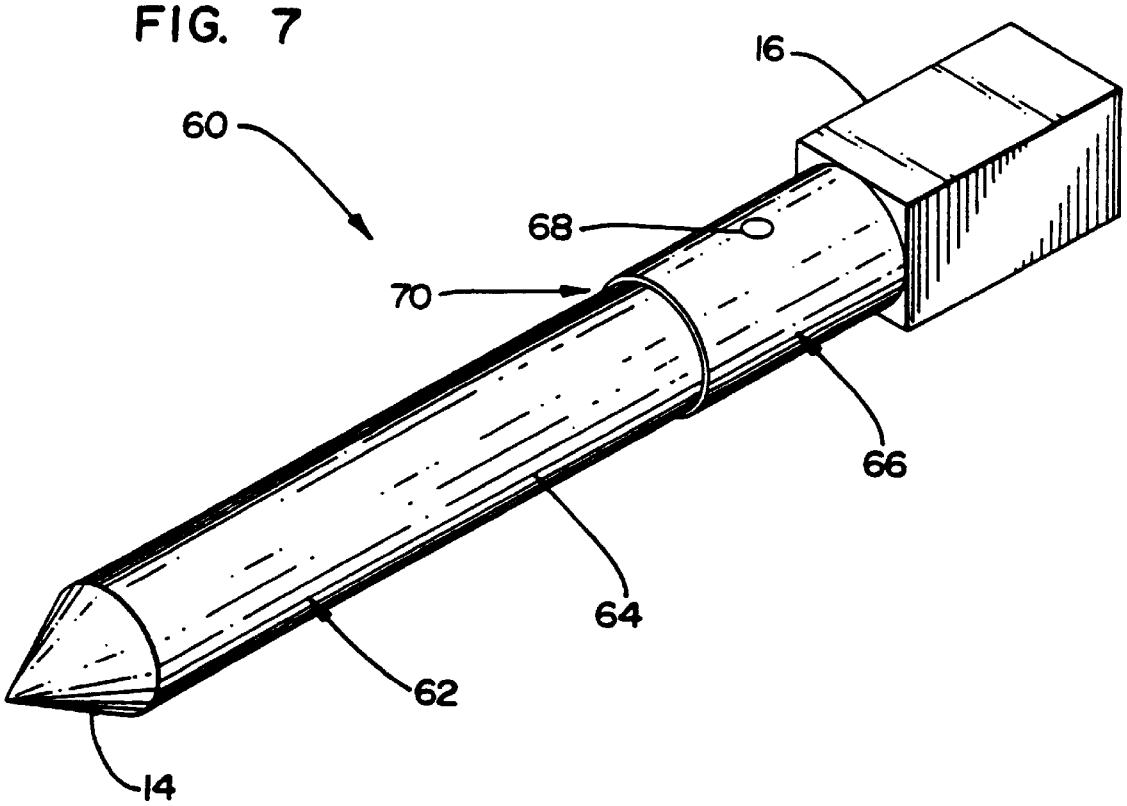
FIG. 7 is a perspective view of a contact element for an electrical connector that is constructed according to a third embodiment of the invention.

It should be understood that the invention is not limited to contact elements that have a rectangular cross section or that have linear contact surfaces. Referring now to FIG. 7, it will be seen that a contact element 60 that is constructed according to a third embodiment of the invention is embodied as a unitary pin 62 that has a leading surface 64, a contact surface 66 having a contact point 68 thereon, and a detent 70 defined between leading surface 64 and contact surface 66. Both leading surface 64 and contact surface 66 are circular in cross section. In this embodiment, contact surface 66 is raised with respect to leading surface 64, and detent 70 is defined by the leading surface 64 and a rise surface that connects the leading surface 64 to raised contact surface 66.

Figure 8:
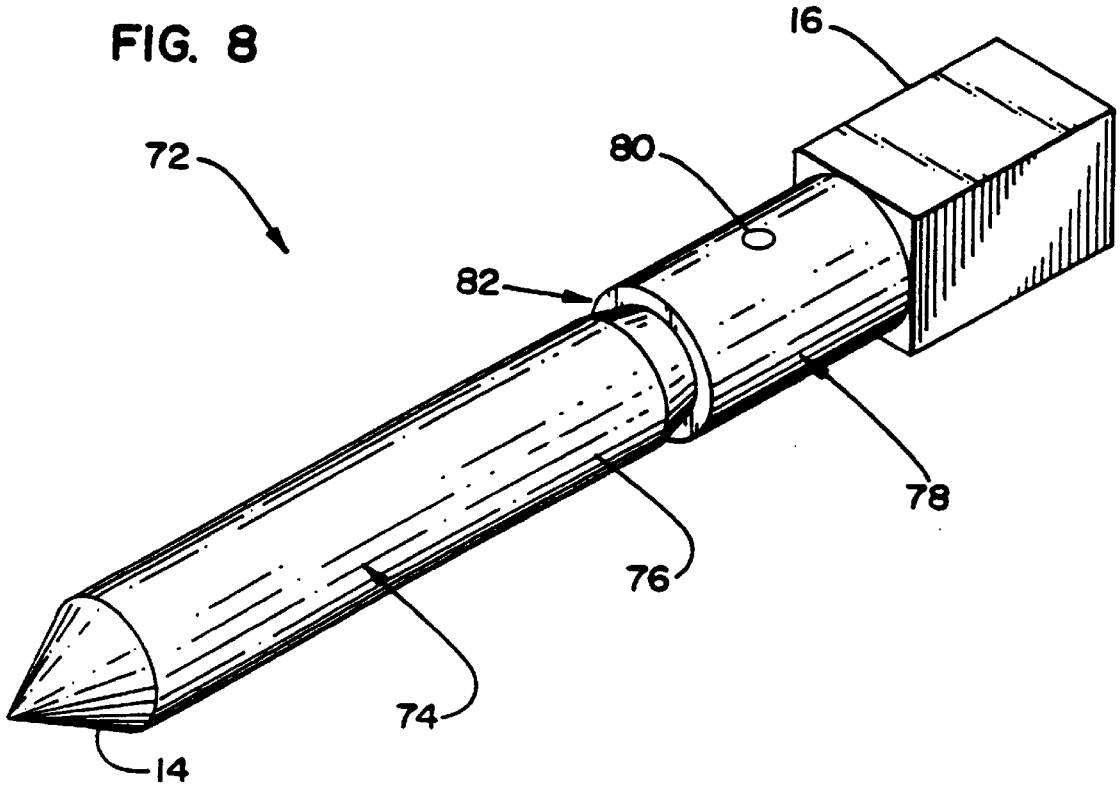
FIG. 8 is a perspective view of a contact element for an electrical connector that is constructed according to a fourth embodiment of the invention.

An improved contact element 72 that is constructed according to a fourth embodiment of the invention is illustrated in FIG. 8. Contact element 72 is embodied as a unitary pin 74 having a leading surface 76, a contact surface 78 having a contact point 80 defined thereon, and a detent 82 that is defined between the leading surface 76) and the contact surface 78. In this embodiment, both leading surface 76 and contact surface 78 are circular in cross section. Contact surface 78 is substantially collinear with leading surface 76, and detent 82 is styled as a groove that is defined between contact surface 78 and leading surface 76. This groove is defined by a first surface that intersects contact surface 78 to form a well-defined edge, so that debris is intercepted by the well-defined edge and collected in the groove. The groove is further defined by a second surface that intersects the leading surface 76 to form a tapered, more gentle edge.

Figure 9:
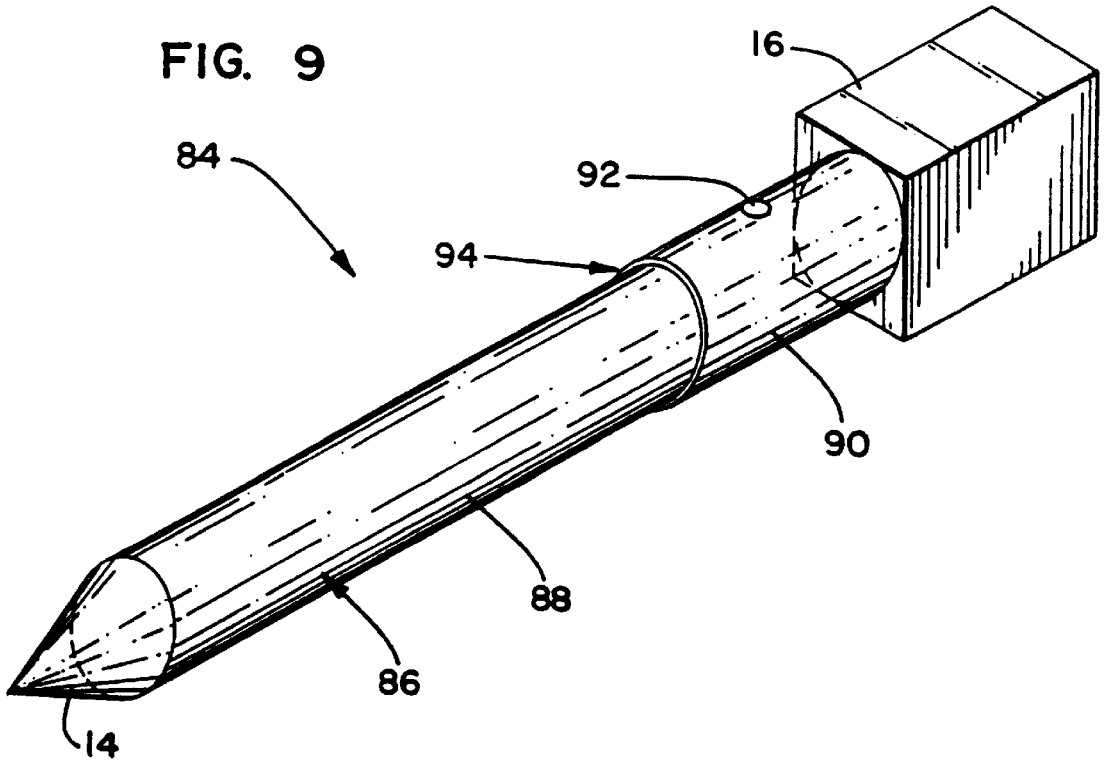
FIG. 9 is a perspective view of a contact element for an electrical connector that is constructed according to a fifth embodiment of the invention.

Looking now to FIG. 9, an improved contact element 84 that is constructed according to a fifth embodiment of the invention is embodied as a unitary pin 86 that has a leading surface 88, a contact surface 90 with a contact point 92 defined thereon, and a detent 94 that is defined between leading surface 88 and contact surface 90. In this embodiment, leading surface 88 and contact surface 90 are both oval in cross section. Contact surface 90 is raised with respect to leading surface 88 and detent 94 is defined by leading surface 88 and a rise surface that connects the leading surface 88 to the raised contact surface 90.

Figure 10:
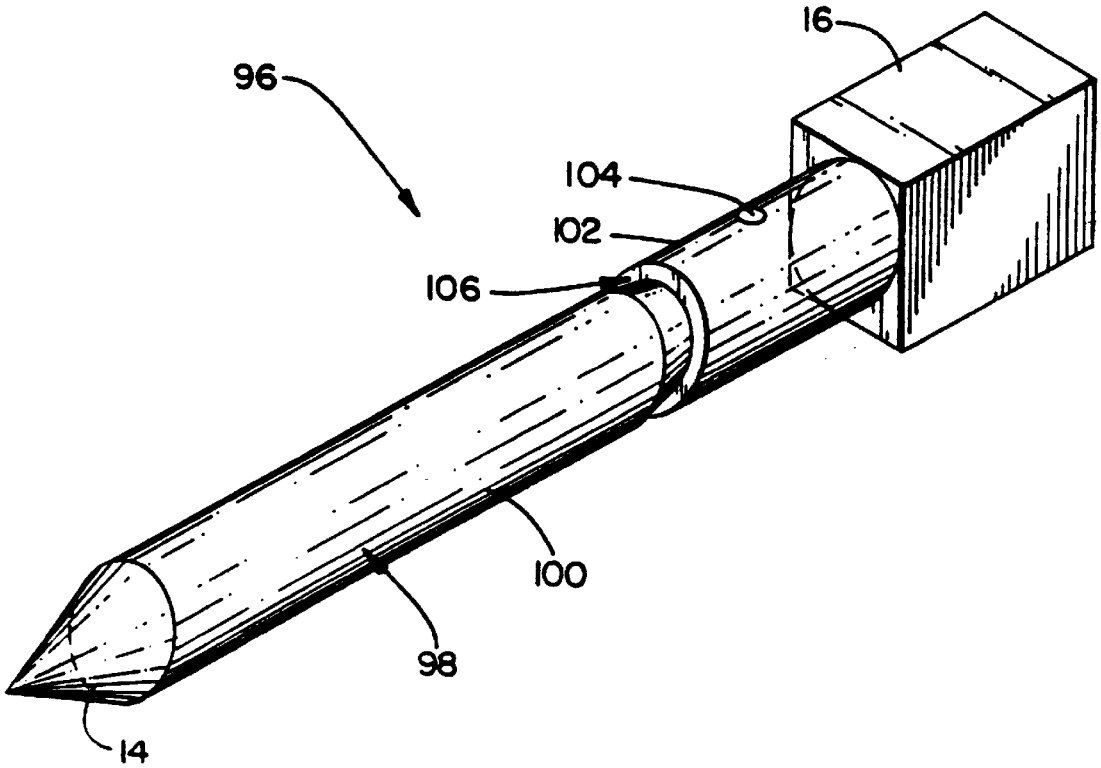
FIG. 10 is a perspective view of a contact element for an electrical connector that is constructed according to a sixth embodiment of the invention.

A contact element 96 that is constructed according to a sixth embodiment of the invention is illustrated in FIG. 10. Contact element 96 is embodied as a unitary pin 98 that includes a leading surface 100, a contact surface 102 that has a contact point 104 defined thereon, and a detent 106 that is defined between leading surface 100 and contact surface 102. In this embodiment, both leading surface 100 and contact surface 102 are oval in cross section, and contact surface 102 is substantially linear with the leading surface 100. Detent 106 is configured as a well-defined groove that is partially defined by a first surface that intersects contact surface 102 to form a well-defined edge, so that debris is intercepted by the well-defined edge and collected in the groove. The groove is also partially defined by a second surface that intersects leading surface 100 to form a tapered, more gentle edge. In all embodiments, a contact element according to the invention will, even when having a very thin plating that is susceptible to micropore corrosion, perform nearly as well over time as a thickly plated contact element because any product of corrosion will be swept from the leading surface and the contact surface into the detent during operation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A one piece plated contact element for an electrical connector which engages an electrically conductive surface on a mating connector comprising:

an electrically conductive contact surface having a non-corrosive plating, said contact surface being constructed and arranged to engage with the electrically conductive surface of the mating connector in order to achieve an electrical connection;

a leading surface being located a lateral space below the contact surface and extending outwardly from the contact surface along a longitudinal axis of the contact element, said contact surface having a peripheral edge which is co-planar with the electrically conductive surface of the mating connector during connection and disconnection of the contact element with and from the mating connector, said leading surface also having non-corrosive plating; and a detent defined by the lateral space between said leading surface and said contact surface, said detent ramping the electrically conductive surface of the mating connector upwardly so as to collect surface debris such as microspore corrosion product from said leading surface before such debris can be wiped onto said contact surface as said peripheral edge of said leading surface is slid along the electrically conducting surface of the mating connector during connection of said contact element to the mating connector, whereby without damaging the non-corrosive plating of the leading and contact surfaces a clean electrical connection may be achieved even in the presence of corrosion products on said leading and contact surfaces as a result of micropores in the plating.

2. A contact element according to claim 1, wherein said contact element comprises a unitary pin, and said contact surface and said leading surface are both positioned on said pin.

3. A contact element according to claim 1, wherein said contact surface is substantially collinear with said leading surface, and said detent comprises a groove that is defined between said contact surface and said leading surface.

4. A contact element according to claim 3, wherein said groove is at least partly defined by a first surface that intersects said contact surface to form a well-defined edge, whereby debris is intercepted by said edge and collected in said groove.

5. A contact element according to claim 3, wherein said groove is at least partly defined by a second surface that intersects said leading surface to form a tapered edge.

6. A contact element according to claim 1, wherein said contact surface is raised with respect to said leading surface, and said detent is defined by said leading surface and a rise surface that connects said leading surface to said raised contact surface.

7. A contact element according to claim 1, wherein said contact surface and said leading surface both are substantially circular in cross-section.

8. A contact element according to claim 1, wherein said contact surface and said leading surface are both substantially oval in cross-section.

9. A contact element according to claim 1, wherein said contact surface and said leading surface are both substantially rectangular in cross-section.

10. An electrical connector that is constructed and arranged to be connected to a mating electrical connector, comprising:

a plurality of plated contact elements, each of said contact elements being of the type that is constructed and arranged for sliding engagement with an electrically conductive surface on the mating connector, each of said contact elements comprising:

an electrically conductive contact surface having a non-corrosive plating, said contact surface being constructed and arranged to engage with the electrically conductive surface of the mating connector in order to achieve an electrical connection;

a leading surface being located a lateral space below the contact surface and extending outwardly from the contact surface along a longitudinal axis of the contact element, said contact surface having a peripheral edge which is co-planar with the electrically conductive surface of the mating connector during connection and disconnection of the contact element with and from the mating connector, said leading surface also having non-corrosive plating; and a detent defined by the lateral space between said leading surface and said contact surface, said detent ramping the electrically conductive surface of the mating connector upwardly so as to collect surface debris such as microspore corrosion product from said leading surface before such debris can be wiped onto said contact surface as said peripheral edge of said leading surface is slid along the electrically conducting surface of the mating connector during connection of said contact element to the mating connector, whereby without damaging the non-corrosive plating of the leading and contact surfaces a clean electrical connection may be achieved even in the presence of corrosion products on said leading and contact surfaces as a result of micropores in the plating.

11. An electrical connector according to claim 10, wherein said contact element comprises a unitary pin, and said contact surface and said leading surface are both positioned on said pin.

12. An electrical connector according to claim 10, wherein said contact surface is substantially collinear with said leading surface, and said detent comprises a groove that is defined between said contact surface and said leading surface.

13. An electrical connector according to claim 12, wherein said groove is at least partly defined by a first surface that intersects said contact surface to form a well-defined edge, whereby debris is intercepted by said edge and collected in said groove.

14. An electrical connector according to claim 12, wherein said groove is at least partly defined by a second surface that intersects said leading surface to form a tapered edge.

15. An electrical connector according to claim 10, wherein said contact surface is raised with respect to said leading surface, and said detent is defined by said leading surface and a rise surface that connects said leading surface to said raised contact surface.

16. An electrical connector according to claim 10, wherein said contact surface and said leading surface both are substantially circular in cross-section.

17. An electrical connector according to claim 10, wherein said contact surface and said leading surface are both substantially oval in cross-section.

18. An electrical connector according to claim 10, wherein said contact surface and said leading surface are both substantially rectangular in cross-section.

19. A method of making a secure electrical connection between a plated contact element of the type having a non-corrosive plating and a mating connector that has an electrically conductive surface, comprising:

(a) moving the contact element into the mating connector so that a plated leading contact surface of the contact element is co-planar with and slides against the conductive surface of the mating connector without scraping that could damage said non-corrosive plating;

(b) further moving the contact element into the mating connector so that a lateral space in the contact element which defines a detent that ramps the conductive surface upwardly as the detent slides past the conductive surface and collects corrosion debris that is deposited by said sliding motion from micropores in the plated contact element and the mating connector; and (c) yet further moving the contact element into the mating connector so that a conductive contact surface of the contact element establishes an electrical connection with the conductive surface of the mating connector, whereby the debris that is collected in the detent will not diminish the quality of the electrical connection between the contact element and the electrical connector.

20. A contact element according to claim 1, wherein said non-corrosive plating on said contact surface and said leading surface comprises gold.

21. An electrical connector according to claim 10, wherein said non-corrosive plating on said contact surface and said leading surface comprises gold.

* * * * *